United States Patent [19]

Hakanson et al.

[11] 4,199,950

[45] Apr. 29, 1980

[54] PRELUBRICATING AND LUBRICATING SYSTEMS FOR ENGINES

[76] Inventors: Alton L. Hakanson, 113-115 Monroe St., Hoboken, N.J. 07030; Wilbur C. Schafer, 4 Brasser La., Kenilworth, N.J. 07033

[21] Appl. No.: 856,275

[22] Filed: Dec. 1, 1977

[51] Int. Cl.[2] ..... F01M 1/08; F01M 1/12

[52] U.S. Cl. ..... 60/605; 123/179 F; 123/196 CP; 184/6.3; 184/6.26

[58] Field of Search ..... 60/39.08, 598, 599, 60/605; 123/196 R, 196 S, 196 M, 179 F; 184/6.26, 6.3

[56] References Cited

U.S. PATENT DOCUMENTS

| | | | |
|---|---|---|---|
| 1,824,540 | 9/1931 | Gronkwist | 184/6.26 |
| 2,747,564 | 5/1956 | Wehling | 184/6.3 X |
| 2,911,267 | 11/1959 | Small | 184/6.26 X |
| 3,045,420 | 7/1962 | Addie et al. | 60/605 |
| 3,917,027 | 11/1975 | Hakanson et al. | 184/6.3 |

*Primary Examiner*—Michael Koczo
*Attorney, Agent, or Firm*—Kirschstein, Kirschstein, Ottinger & Cobrin

[57] ABSTRACT

A system for prelubricating an engine wherein lubricating oil is delivered to relatively movable parts of the engine during starting in the form of an atomized mist generated by an atomizing spray nozzle operating under an extremely high pressure in the order of 250 to 10,000 psi, so that not only is the mist extremely fine but the oil particles thereof are projected from the nozzle at a high velocity that causes the mist to penetrate into every interstice between relatively movable parts and over every set of relatively movable surfaces so as to coat all parts of the engine which would be subjected to frictional wear were it not for the presence of the oil particles. Moreover, in such system, and particularly in a system employing parts that experience relative rotation at very high speeds such, for instance, as the journals and bearings of a turbocharger, the instant prelubricating system furnishes lubricating oil, e.g. as a solid slug, over a somewhat protracted period as the engine and turbocharger are starting and as the turbocharger comes up to full speed after the engine has started so that the lubricating operation that precedes normal lubrication extends beyond the starting period of the engine and into the running period of the turbocharger, a matter of approximately 2 to 5 seconds for the starting period and for another 5 to 10 seconds into the running period of the turbocharger.

11 Claims, 2 Drawing Figures

PRELUBRICATING AND LUBRICATING SYSTEMS FOR ENGINES

BACKGROUND OF THE INVENTION

1. Field of the Invention

Prelubricating and lubricating systems.

2. Description of the Prior Art

One, although not the only, use of the present invention is in connection with the starting of a stand-by engine which is employed when a main engine fails. A prior art prelubricating system which is quite satisfactory is shown in U.S. L. Pat. No. 3,917,027 granted Nov. 4, 1975. The system of that patent, which was a substantial improvement over prelubricating systems that preceded it as, for example, those shown in U.S. L. Pat. Nos. 3,472,024 granted Oct. 14, 1969, 3,583,525 granted June 8, 1971, 3,583,527 granted June 8, 1971 and 3,722,623 granted Mar. 27, 1973, was predicated upon the use of a stand-by highly pressurized source of hydraulic oil which was employed both to crank a stand-by engine and to energize a prelubricating system, the highly pressurized oil being provided with two work paths, one that cranked the engine and the other that actuated a prelubricating network. The hydraulic resistance of the prelubricating network was lower than the hydraulic resistance of the cranking network, so that when the stand-by engine was called into service the prelubricating network would be rendered operable before the cranking network, thus ensuring prelubricating before starting, i.e. furnishing a very short time delay prior to starting during which time delay the prelubricating was effected.

This system has proven to be an excellent one. It has, however, encountered a certain problem which pertained to engines that used turbochargers. Turbochargers operate at extremely high speeds, a typical speed being 55,000 rpm. A turbocharger does not immediately turn over at a high operational speed. When the engine is cranking there is practically no movement of the turbocharger; but the instant the engine fires, the exhaust gas from the engine is fed to the turbine section of the turbocharger which very quickly comes up to speed, and in from 2 to 3 seconds from the time that the engine has started, by which time the engine is at normal engine running speed, the turbocharger will be rotating at about 50,000 rpm. However, the turbocharger will have reached full speed and will be running for a few seconds, e.g. 4 to 5 seconds, before the lubrication oil from the engine pump reaches the bearings of the turbocharger. This is a "starve" period, although a short one, when damage can occur. It is absolutely essential that the bearings of a spinning turbocharger be continuously oiled to prevent substantial wear or or breakdown of the turbocharger before the engine lubrication pump takes over.

Thus, the system of U.S. L. Pat. No. 3,917,027 was not a suitable one for an engine that had a turbocharger operating in conjunction with it. The prelubricating supplied by this prior patent only would furnish oil to the turbocharger prior to starting of the engine, and there still was a short period of delay in lubricating the turbocharger which began when the prelubricating cycle ended and terminated when the engine was operating at full speed and its oil pump was furnishing oil in a sufficient amount and under a sufficient pressure to the turbocharger. In this short period of about 10 seconds substantial damage could be done to the turbocharger It was desirable that this be eliminated.

Moreover, the prelubricating system of U.S. L. Pat. No. 3,917,027 was restricted in its application of prelubricating oil to existing oil passageways within the engine, since it supplied an initial burst of prelubricating oil to the lubricating system of the engine; that is to say, it supplied prelubricating oil to the sundry passageways and capillaries through which oil delivered by the oil pump of the engine ordinarily would force oil to bearings and the like. It could not, for example, conveniently supply prelubricating oil to the pistons and the cylinders and the valves and sundry relatively movable surfaces throughout the engine in the absence of oil passageways terminating at these various elements and surfaces. Since the cylinders can be dry after long periods of standing, the seal between the piston and cylinder is inefficient, with consequent loss in compression which in a diesel engine will delay firing.

In addition, a similar problem was encountered with starting of engines in general. Thus, it might be desired to start and engine in a very cold climate where oil had congealed or where oil had drained away from relatively movable parts, and it was difficult to force prelubricating oil through passageways filled with viscous oil to these relatively movable parts prior to starting.

Up to the present time no prelubricating or lubricating system has been proposed that would overcome all of these drawbacks.

SUMMARY OF THE INVENTION

1. Purposes of the Invention

It is an object of the invention to provide a prelubricating and lubricating system which is not subject to any of the foregoing difficulties.

It is another object of the invention to provide a prelubricating and lubricating system which is specially designed to be used in conjunction with a source of highly pressurized hydraulic oil which is available on a stand-by basis such, for example, as hydraulic oil stored in an accumulator and pressurized by gas, preferably an inert gas, e.g. nitrogen, in a chamber in the accumulator, which desirably is separated from the hydraulic oil by a piston slidable in the accumulator, such accumulators with slidable pistons separating a pressurized gas and pressurized liquids being well known in the art and conventionally being found in association with engines, particularly fluid-cranked engines.

It is another object of the invention to provide a prelubricating system of the character described in which prelubricating is performed not only during the starting of the engine but for a short period thereafter, preferably in conjunction with a turbocharger, which period is of a sufficient span to ensure that the normal lubricating mechanism operated by the started engine will assume all necessary lubricating functions.

It is another object of the invention to provide a prelubricating system of the character described in which a prolonged prelubricating period such as just described takes place and wherein the engine has a turbocharger associated therewith.

It is another object of the invention to provide a prelubricating system of the character described in which a solid flow of oil is supplied during the prolonged prelubricating period to a turbocharger.

It is another object of the invention to provide a prelubricating system of the character described in which the prelubricating of relatively movable engine parts, optionally excluding those of the turbocharger, are prelubricated by a fog of lubricating oil that has been highly atomized under very high pressure in the order of, for example, 250 to 10,000 psi, whereby fine, rapidly moving particles of oil in a fog of oil will diffuse onto all relatively movable surfaces of the engine, optionally from a single atomizing device in the engine sump.

It is another object of the invention to provide a prelubricating system of the character described in which there is a combination of a prelubricating atomized fog of the type mentioned and a solid prolonged flow of prelubricating oil to a turbocharger.

It is another object of the invention to provide a prelubricating system of the character described in which the generation of the finely atomized fog of lubricating oil is halted prior to the termination of the prolonged period of solid oiling to a turbocharger.

It is another object of the invention to provide a prelubricating system of the character described having a combination fogging, prelubricating and solid lubrication of a turbocharger, wherein a device is included to ensure the prolongation of a solid oil stream to a turbocharger.

It is another object of the invention to provide a lubricating system of the character described which supplies a fog of very fine oil particles atomized by the use of very high pressure so that these particles will permeate the interior of the engine and lubricate all relatively movable surfaces during normal operation of the engine, i.e. subsequent to starting, that is to say, an engine which includes a source of highly pressurized lubricating oil and a device to atomize lubricating oil, the device being located internally of the engine to supply the aforesaid lubricating very fine high-velocity particles.

Other objects of the invention in part will be obvious and in part will be pointed out hereinafter.

2. Brief Description of the Invention

A system of the present invention is characterized by two features. One is the performance of prelubrication of relatively movable engine parts with the exception of a turbocharger. The second feature is the lubrication of the turbocharger prior to the starting of the engine which lubrication continues after starting of the engine and until the turbocharger has had an opportunity to run up to substantially its operating speed.

Concerning the first feature, in accordance with the instant invention the same is effected by the use of a standard component that is used to crank a fluid-cranked engine; thus, typically a diesel engine is provided with a high energy source of fluid power to rotate the same for starting inasmuch as considerable power is needed to compress the fuel/air charge in the cylinders sufficiently to bring it to the point of combustion. Most commercial diesel engines use a standby source of fluid under high pressure which is connected to a fluid-driven cranking motor to start the engine. The first feature of the invention uses this high-pressure source of fluid for the purpose of prelubrication. Customarily, the high-pressure source of fluid is oil such as hydraulic oil. The oil is contained in a storage cylinder (accumulator) on one side of a piston that floats in the cylinder. The balance of the cylinder on the other side of the piston contains as inert gas, e.g. nitrogen. Oil is force into the cylinder under pressure causing the piston to travel against the nitrogen charge and compress the nitrogen to a high pressure, e.g. 10,000 psi, conventionally 3,000 psi. The oil remains in the storage cylinder under such high pressure awaiting its utilization for turning over the fluid-driven cranking motor. It is this oil which is employed to effect the first feature of the present invention. The stand-by hydraulic oil is used to pressurize lubricating oil. A passageway is provided from the lubricating oil under high pressure, the passageway leading to a spray nozzle which is situated within the engine, i.e. internally of the engine, for example, in the engine sump above the level of oil that has drained down into the sump when the engine is idle. The spray nozzle, when lubricating oil is fed thereto under the high pressure just mentioned, will cause atomized particles of oil to be discharged within the engine, leaving the nozzle at a high velocity. This oil will essentially instantaneously permeate the interior of the engine as it starts to rotate and reach all surfaces that will experience relative movement during normal operation of the engine whereby to lubricate these surfaces. Typical such surfaces are the walls of the pistons and cylinders, all bearings and journals and all rocker arms and cams. As above noted, the lubricating oil is not acted upon directly by the compressed gas in the stand-by accumulator which stores hydraulic oil under pressure for cranking the engine and, instead, the hydraulic oil from the accumulator is discharged into a cylinder having a floating piston, one side of the cylinder containing hydraulic oil and the other side of the cylinder containing engine lubricating oil. This arrangement eliminates the necessity of providing additional accumulators containing just gas and engine lubricating oil and permits conventional accumulators to be used.

Concerning the second feature, in accordance with the instant invention the same is effected by the use of the same stand-by accumulators. However, instead of atomizing a slug of lubricating oil under the extremely high pressure mentioned, solid slug of lubricating oil, unatomized, is fed to the turbocharger at a reduced pressure. The initial portion of this solid slug of oil will reach the turbocharger bearings as the engine is being started up. Thereafter, while the engine is starting and even after the engine has started, solid oil continues to be fed to the turbocharger bearings for a predetermined short period of time, for example, 4 to 6 seconds after the engine has started, which is long enough to permit oil leaving the engine oil lubricating pump to reach the turbocharger bearings. Then, a timing arrangement which has been, in effect, measuring the time period of feed of start-up lubricating oil to the turbocharger bearings cuts off this feed.

The invention consists in the features of construction, combination of elements and arrangement of parts which will be exemplified in the systems hereinafter described and of which the scope of application will be indicated in the appended claims.

BRIEF DESCRIPTION OF THE DRAWINGS

In the accompanying drawings in which are shown various possible embodiments of the invention.

PREFERRED EMBODIMENTS OF THE INVENTION

Figure 1:
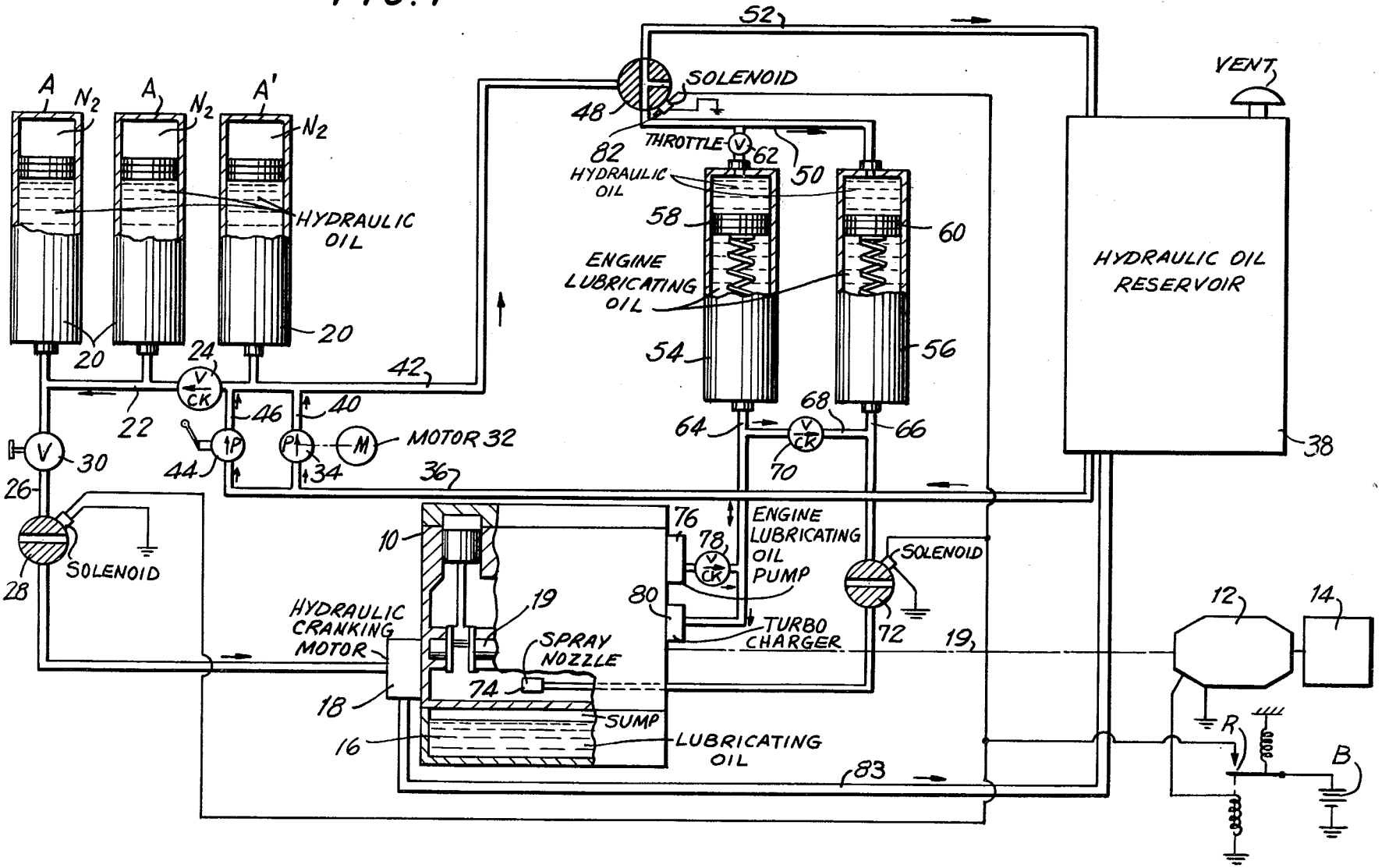
FIG. 1 is a partially sectional, partially schematic view of a system embodying the present invention which includes both the engine prelubricating and the turbocharger initial lubrication features, the system being shown in conjunction with a compression ignition engine, a principle engine, and a generator.

Referring now in detail to the drawings, the reference numeral 10 denotes a stand by engine arranged to drive an electric generator 12 which normally is arranged to be driven by a main engine 14. The engine 14 is a heavy-duty engine designed to operate for long periods of time without breakdown and is the principle source of power for driving the generator 12. There may be two generators 12, each connected to a common electric power main, one generator being arranged to be driven by the principle engine 14 and the other (stand-by) generator being arranged to be driven by the stand-by engine 10. Thereby if a normally used generator or a normally used engine should fail, the stand-by engine and the stand-by generator would come into play. The number of generators employed will depend upon the particular requirements of the installation and the economics thereof.

The stand-by engine 10 conventionally will be a diesel engine or a natural gas engine or a gas turbine engine, all of these being engines which are powered by a combusted fuel. The stand-by engine 10 customarily will not have been used for a considerable period of time before it is called into service suddenly and, therefore, all of the lubricating oil therein will have drained to the crank case, i.e. sump 16, so that the bearings, notably the main bearings, the cylinder walls, the pistons, the rocker arms and the cams will be dry. The amount of residual oil thereon is negligible. It is completely insufficient to lubricate the bearings, the cylinder walls, etc. when the engine is operating at normal speed, regardless of whether a load is present or absent. Moreover, the oil in the engine is not under pressure and, therefore, will not provide a film of sufficient thickness to afford suitable lubrication and prevent burning out of the bearings. Still further, the oil in the lubricating passageways will be viscous because of age and long standing, and possibly also because of cold ambient temperatures.

It is absolutely necessary that the stand-by engine 10 be quick starting so that electric and motive power will not have a chance to fall off when the main engine stops. To enable an engine such as the stand-by engine 10 that drives a generator of any appreciable size to start rapidly, it is most desirable to spin the engine quickly for starting, that is to say, to be turned over as by cranking at a speed far in excess of that which is attainable by conventional electric cranking motors. The start must be quick and positive. Slow starting or the possiblity of a non-start simply is unacceptable.

Such high-speed cranking motors are well known, as are the means for accomplishing high-speed cranking. High-speed cranking customarily is performed by a motor that is energized by a source of fluid energy under high pressure. Best results are obtained where the source of fluid energy is liquid such, for instance, as a pressurized hydraulic fluid, the pressurization being accomplished by gaseous means such as a cushion of an inert gas. This kind of cranking motor is notoriously reliable for a very fast start of an engine, notably of a diesel, i.e. compression ignition, engine. It overcomes the high inertia of the engine quickly and quickly brings the engine up to a speed sufficient for starting and sufficient for compression of the fuel/air charge in the cylinders.

In the aforesaid fluid cranking system, cranking of the engine is effected by a fluid-driven cranking motor 18 having a pinion (not shown) designed to engage a gear (not shown) on the shaft 19 of the engine 10. Such source of high-pressure fluid is provided in the system illustrated by one or a few hydraulic accumulators 20, three being shown connected in parallel. If desired, instead of hydraulic accumulators, compressed air flasks, e.g. vessels, can be employed which are connected to the cranking motor. Each of the hydraulic accumulators is a cylinder with an internal floating piston on one side of which, the upper side shown in the figures, is a cushion of an inert gas, e.g. nitrogen. The other side of each accumulator contains hydraulic oil. When an accumulator is charged the piston is high in the accumulator and the inert gas is compressed to provide a high energizing pressure, e.g. 10,000 psi (usually lower, e.g. 3,000 psi). When the piston approaches the discharge end of the accumulator and the gas cushion has expanded, the pressure of the hydraulic oil will be considerably reduced, typically to about 250 psi (usually higher, e.g. 500 psi).

The three accumulators are ganged in parallel by a conduit 22, a one-way check valve 24 being interposed in the line between the accumulators A,A and the third accumulator A'. The check valve is oriented to permit flow of hydraulic fluid from the accumulator A' to the accumulators A,A, but no flow in the reverse direction. A conduit 26 leads from the conduit 22 on the accumulator A side of the check valve 24 to the hydraulic cranking motor 18. The conduit 26 includes a solenoid-actuated, normally-closed, two-way valve 28. Since this valve is normally closed, the hydraulic cranking motor is normally idle. The solenoid for the valve 28 has its energizing coil (not shown) connected to a stand-by source of electric power, e.g. a battery B, through a normally-open relay R which is maintained open by the electric power supplied by the generator 12. Hence, as soon as the generator 12 stops because of failure of the main engine 14, the contacts of the relay close so as to energize the solenoid of the two-way valve 28 which thereupon opens and connects the high-pressure hydraulic oil from the accumulators A,A,A' to the hydraulic cranking motor. A hand-operable valve 30 is interposed in the conduit 26 between the conduit 22 and the two-way valve 28. This valve is open during normal operation of the system and only is closed for maintenance or repair.

The accumulators are suitably charged, that is to say, hydraulic fluid is forced into the accumulators under high pressure so as to compress the cushion of inert gas. This can be done in various fashions. The arrangement shown in the present system includes both electrical and manual charging means. The electrical means constitutes a motor 32 driving a pump 34, the inlet of which is connected by a conduit 36 to a vented reservoir 38 containing hydraulic fluid under atmospheric pressure. The outlet of the motor is connected by a conduit 40 to a conduit 42 on the infeed side of the check valve 24, which conduit 42 also is connected to the accumulator A' and through the check valve 24 to the conduit 22 that runs to the accumulators A,A. The motor 32 is connected to a source of electric power (either a generator or a battery) through a normally-open pressure switch which closes to start the motor when the pressure of the hydraulic fluid, and therefore the gas cushion, in any one of the accumulators A,A or A' reaches a pressure below 2,600 psi (assuming a stand-by pressure of 3,000 psi) or about 9,500 psi (assuming a stand-by pressure of 10,000 psi). Customarily, the electric motor simply is driven by the power obtained from the generator 12 on the assumption that the stand-by engine always will start up. However, if a problem is anticipated or great safety is desired, the electric motor 32 can be arranged to be driven from a stand-by source of power such as a battery so as to be able to effect a second start should the first one fail. Moreover, to ensure the ability to re-start under the worst of conditions, a hand pump 44 is included in the system, its input being connected to the conduit 36 and its output being connected to a conduit 46 that runs to the conduit 42.

The engine cranking portion of the system just described does not include the delay feature disclosed in U.S. L. Pat. No. 3,917,027 inasmuch as the prelubricating system of the present invention still to be described in detail not only is very reliable but also essentially is instantaneous so that the prelubrication will take place even as the engine starts to be cranked and at the same time that the first movement of any part of the engine is effected. The new prelubricating system makes the incorporation of any delay in starting of the engine useless and, therefore, unnecessary since it is most desirable to start the engine as quickly as possible when any emergency arises that causes shutdown of the main engine 14. It is the check valve 24 that prevents any delay in starting of the engine since it isolates the accumulators A,A which are connected to the hydraulic cranking motor from the accumulator A' which soon will be seen is connected to the prelubricating system and to the turbocharger bearings, although a reverse flow, i.e. of the hydraulic oil from the accumulator A' to the hydraulic cranking motor is permitted. If desired, the connection between the conduits 22 and 42 can be eliminated, in which case, however, separate pumps for the accumulators A,A will be needed, or, in the alternative, an arrangement to separate the flow of pressurized fluid from the pumps to the accumulator A' on the one hand and to the accumulators A,A on the other.

The conduit 42 runs between the accumulator A' and a three-way solenoid-controlled valve 48 having an idle position and an operating position. In its idle position the conduit 42 is terminated at said valve 48, and said valve 48 connects a conduit 50 to a conduit 52. The conduit 52 leads from the valve 48 to the vented oil reservoir 38. The connections of the conduit 50 will be described shortly hereinafter. In its operative position the valve 48 connects the conduit 42 to the conduit 50 while the conduit 52 is terminated at the valve 48. The conduit 50 is connected in parallel to two cylinders 54,56, each including a floating piston 58,60, respectively. A throttle valve 62 is interposed between the conduit 50 and one of the cylinders 54,56, specifically the cylinder 54. The ends of the cylinders 54,56 fed by the conduit 50 contain hydraulic oil. The opposite ends of the cylinders contain engine lubricating oil. Conduits 64,66 lead from the cylinders 54,56, respectively. These conduits are cross-connected by a conduit 68 containing a check valve 70 which permits flow only from the conduit 64 to the conduit 66. The conduit 66 beyond its point of connection to the check valve 70 is interrupted by a two-way normally-closed solenoid-controlled valve 72. All three valves 28, 48 and 72 are simultaneously actuated when the main electric power fails. The conduit 66 leads through the valve 72 to an atomizing nozzle 74 located internally of the engine, desirably in the sump above the level of the oil therein when the stand-by engine is idle. Any atomizing nozzle will operate satisfactorily. Excellent results have been obtained with nozzles manufactured by Spraying Systems Co., and particularly with their wide hollow cone spray pattern nozzles of the AX and BX types, these being known by the trademark "WhirlJet" wide spray nozzles. These have a spray angle (the angle of the apex) of about 120°. The particular size of the nozzle is not critical. Such nozzles are available with a body inlet diameter varying from 1/32" to 19/64", and an orifice diameter of from 3/64" to 5/16". The larger sizes are more applicable to larger engines and the smaller sizes to smaller engines. However, any size will work satisfactorily in any engine since even the smaller nozzles provide a usable prelubrication.

The main consideration in connection with prelubrication of the present invention is the extremely high pressure available and used pursuant to the instant system for atomizing oil at the moment that the cranking motor for the stand-by engine is actuated. This atomizing pressure reduces the oil fed to the nozzle into extremely small particles and projects them throughout the interior of the engine, the oil being caused to penetrate and permeate into the finest of interstices and smallest of spaces as a very rapidly moving fog of minute particles having sufficient momentum to penetrate deep into tiny crevices of substantial length. Thus, the fog of oil will enter into the main bearings of the engine in the space between the journals and bearings right up to the point that the journals actually contact the bearings and leave no space at all, this conceivable disadvantage immediately being overcome by the rotation of the journals. The fine fog will penetrate into passageways for lubricating oil, which passageways contain viscous or congealed oil, in order to free the same and to reach surfaces to be lubricated. The fine fog penetrates the space between the pistons and the cylinders, lubricating the opposed walls of the same to form a good seal that prevents loss of compression. The fine fog penetrates the passageways through which the valve rods extend to lubricate the rods and to deposit on the valve seats. It also penetrates the passageways leading to valve lifters and to rockers and to cams and, indeed, to all internal moving parts of the engine. The moving particles reach all surfaces to be lubricated essentially instantaneously, as the engine starts to turn.

If desired, more than one nozzle can be placed in the engine sump, although the same should not be necessary. If a particular engine design is such as to cause doubt to the designers that the prelubricating fog will reach some particular area or zone of the engine which is of difficult access or which requires an exceptional amount of prelubricating oil, an additional nozzle can be placed near such location. Nevertheless, to repeat, in a conventional diesel engine such as is employed for stand-by purposes and which is not a very large engine of extremely high horsepower, one nozzle usually will be sufficient for the purpose of prelubrication pursuant to the present invention.

The conduit 64 leads to an engine oil lubricating pump 76 through a check valve 78 which permits flow of oil only in a direction from the pump to the conduit 64. The conduit 64 also leads to the bearings for a turbocharger 80.

The solenoid for the valve 48 includes a timer 82 which will maintain the valve in its operated position (connecting the conduit 42 to the conduit 50) for a predetermined period of time which is sufficient to ensure that the bearings for the turbocharger will be lubiricated until the lubricating oil pump can supply sufficient lubricating oil at a sufficient pressure to lubricate the turbocharger bearings. A suitable period of time to maintain the valve 48 actuated is approximately 6 to 10 seconds.

The system operates as follows. Assume the main engine 14 is operating and the generator 12 is supplying electric power. At this time the valve 30 will be open and the valves 28, 48 and 72 will be idle. The accumulators A,A,A' will be at full charge, i.e. from 3,000 to 10,000 psi, depending upon the parameters of the particular engine and cranking system involved. Said accumulators will be filled with a substantial charge of hydraulic oil under very high pressure as just mentioned. The floating pistons therein will be near the dead (closed) ends of the accumulators. The floating pistons in the cylinders 54,56 will be at the ends of the cyllinders nearer the conduit 50, and the lower ends of the cylinders will be full of engine lubiricating oil. The oil reservoir will be partially full of hydraulic oil. There will be, however, an empty head space. When the main engine fails and the generator 12 shuts down, the switch mentioned heretofore will close to simultaneously energize the solenoids that operate the valves 28, 48 and 72.

When the valve 28 shifts to actuated condition the passageway through it connects the conduit 26 to the conduit 28 so as immediately to permit flow of hydraulic fluid from the accumulators A,A though the conduit 26 and the valve 28 to the hydraulic cranking motor 18 whereby the cranking of the engine starts a fraction of a second after the relay R closes.

Concurrently with actuating the valve 28, the valve 48 is actuated by its solenoid. When the valve 48 is actuated, the connection between the conduits 50, 52 is broken and a connection is effected between the conduits 42 and 50. This has the effect of introducing hydraulic fluid under high pressure from the accumulator A' to the hydraulic oil end of the cylinders 54, 56 and, hence, of pressurizing the engine lubricating oil in said cylinders at essentially the very instant that the engine cranking commences.

The valve 72 is actuated concurrently with actuation of the valves 28, 48. Opening the normally-closed valve 72 permits engine lubricating oil under the extremely high pressure mentioned to be led to the spray nozzle 74. As indicated previously, when engine lubricating oil under the extremely high pressures referred to issues from a spray nozzle, the oil is atomized into minute particles which are projected at a very high velocity through the interior of the engine as a fine mist or fog which penetrates all spaces in the engine no matter how small they may be, so that the oil reaches all surfaces to be lubricated the moment that the engine starts to turn. This obviates any need to delay the starting of the engine for a period to permit prelubrication to become effective. The rapidity and extent of the penetration of this fine mist within the engine is almost unbelievable and is due not only to the fact that the oil is atomized but to the fact that the atomization takes place under extremely high pressures. It has been found that the miminum pressure used for cranking engines with hydraulic oil, which pressure is transmitted to the engine lubricating oil, is sufficient to obtain the desired fineness and rapidity of penetration to the oil mist. This pressure is, of course, about 3,000 psi. Higher pressures are no less effective. The lubrication effected at lower pressures using the sytem of the present invention, i.e. a spray nozzle through which lubrication oil is forced at a considerable pressure rather than an extremely high pressure, also provides good lubrication, although quite apparently not as fast nor as thorough nor as reliable as the lubrication which takes place under extremely high pressures, e.g. in the order of at least 3,000 psi. In the system herein illustrated this pressure is maintained because of the pressure sensors in the accumulators A which cause the high pressure to be maintained even as the hydraulic oil starts to be drained out of the accumulators during the pressurization of the engine lubricating oil in the cylinders 54, 56. In other words, the very high pressure which is present on a stand-by basis in the accumulatos A never is lowered to any substantial extent, being maintained by the motor 32 and the pump 34.

When the engine lubricating oil in the cylinder 56 is raised to a very high pressure upon actuation of the valve 48, the hydraulic oil in the head end of the cylinder 54 likewise is pressurized. However, the hydraulic oil in this cylinder and the engine lubricating oil in this cylinder are not raised to the full pressure of the accumulator A ' due to the presence of the throttle valve 62. This valve acts as a pressure reducer so that, assuming the piston 58 in the cylinder 54 moves down and there is a discharge of engine lubricating oil from beneath the piston 58, the pressure of such engine lubricating oil is considerably lower than the pressure of the hydraulic oil in the accumulator. The throttle valve 62 is manipulated or selected to obtain a sufficiently low pressure in the engine lubricating oil section of said cylinder 54. The oil at this lower pressure leaves through the conduit 64. It cannot branch over to the conduit 66 through the check valve 70 due to the fact that the considerably lower pressure of the hydraulic oil in said conduit 64 is unable to open the check valve against the very high pressure of the engine lubricating oil in the conduit 66. Thus, the engine lubricating oil flowing through the conduit 64 enters the bearings of the turbocharger 80. It was because this oil is used to lubricate the bearings of the turbocharger that its pressure had to be considerably reduced, otherwise the oil simply would shoot through the turbocharger bearings and possibly do some damage if it had been at a very high pressure.

The atomization lubrication of the engine through the spray nozzle 74 continues until the piston 60 bottoms in the cylinder 56 which will take place in a few seconds. The engine will start up rather quickly, usually in from 2 to 4 seconds, and at this time the engine lubricating oil pump will supply sufficient oil under sufficient pressure to take over the task of lubricating the relatively movable engine parts. However, the turbocharger bearings present a different problem. The turbocharger is run by the exhaust from the engine, so until the engine starts, the turbocharger will not start; that is to say, the engine actually must be running before the turbocharger will start up and, even after that, a period of a few seconds will elapse before the engine lubricating oil pump can supply oil in sufficient quantity to lubricate the turbocharger at the latter's operating speed which is in the vicinity of 55,000 rpm. There thus is a starve period for the turbocharger bearings between the time that the engine has started and the time that the engine lubricating oilpump can supply sufficient oil and sufficient pressure to lubbricate the turbocharger bearings. Hence, it is desirable, indeed necessary, to supply oil to the turbocharger for a longer period of time than to supply prelubricating oil to the engine exclusive of the turbocharger. To accomplish this, the solenoid for the valve 48 includes the time delay latch 82 which will maintain the valve 48 in operated condition long enough to supply a solid slug of oil to the turbocharger bearings for the extended period just mentioned. The extension of the operated period of the valve 48 does not affect the period over which atomized oil is supplied to the engine because the piston 60 will bottom in the cylinder 56. However, the descent of the piston 58 in the cylinder 54 is slower than that of the piston 60 principally due to the presence of the throttle valve 62, so that a solid slug of oil continues to be fed through the conduit 64 for the period of time required. Due to the check valve 78, engine lubricating oil does not flow from the cylinder 54 into the pump 76 or the engine 10 during the starting period.

When the engine 10 has started up and is operating, it will drive the generator 12, the electric power from which will open the relay R and permit the valve 28 to be returned under bias to its idle closed position. Likewise, the valve 72 will be biased back to its normally-closed idle position; the prelubricating spray no longer is needed because the engine now has started up. If desired, a short time delay may be introduced into the operation of the valve 72 to permit a few seconds of lubricating oil spray after the engine has started; it can do no harm. However, as pointed out previously, the valve 48 stays in its operated condition after the motor 10 has started and the generator 12 is operating, this being necessary for the extended period of solid lubricating application of oil to the turbocharger bearings. When the time delay period for the valve 48 expires, this valve will return to its idle condition in which the conduit 50 is connected to the conduit 52. Now oil from the oil pump will flow into the lower ends of the cylinders 54,56 (employing the check valve 70 for the cylinder 56) which will re-fill the lower ends of said cylinders with engine lubricating oil and will force the pistons 58, 60 toward the dead ends of said cylinders. Such hydraulic oil will enter the conduit 50, flow through the valve 48, and then flow through the conduit 52 into the hydraulic oil reservoir. The pistons 58, 60 will remain at the dead ends of their respective cylinders until the next starting of the stand-by engine 10 is to be achieved. Hydraulic oil used to energize the hydraulic cranking motor 18 and flowing out of said motor will be returned through a conduit 83 to the hydraulic oil reservoir.

Although the valves 28, 48 and 72 have been illustrated as electrically operated, it is within the purview of the invention to operate the same mechanically. For simplicity, all the valves may be connected to be actuated by turning of a single handle.

Figure 2:
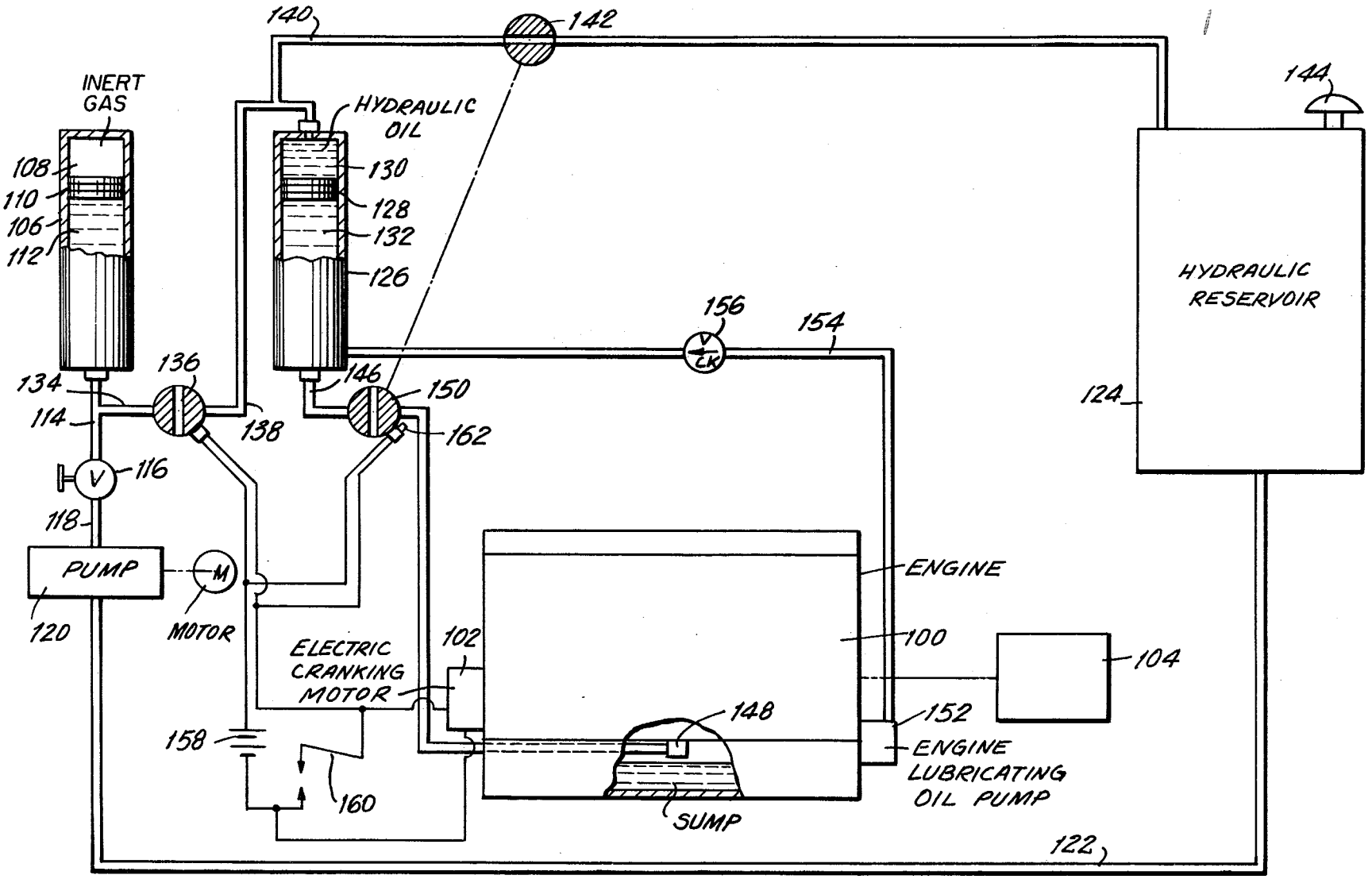
FIG. 2 is a view similar to FIG. 1 of a simpler system for use with an engine not equipped with a turbocharger or not equipped with a turbocharger initial lubrication arrangement such as the one shown in FIG. 1.

The present invention can be used to function for prelubricating alone if no turbocharger is present, and such a system has been illustrated in FIG. 2. In this figure the reference numeral 100 denotes a reciprocating engine, optionally of the diesel type. The engine has an electric cranking motor 102 connected to its drive shaft. When running, the engine operates a utilization load 104 which may be a generator, a pump, etc. Although the engine is designed to be started with an electric cranking motor, said engine is furnished with a stand-by accumulator 106 having a cushion of gas, e.g. an inert gas such as nitrogen, 108 in its head space. A piston 110 is located in the accumulator and separates the inert gas cushion from a body 112 of hydraulic liquid such as hydraulic oil. The hydraulic oil 112 in the accumulator is connected to a conduit 114 that runs to a hand-operated valve 116 that is employed when it is desired to maintain or repair the system here being described. From the valve 116 a conduit 118 runs to a pump 120, the inlet of which is connected by a conduit 122 to a hydraulic reservoir 124. A cylinder 126 is provided having a floating piston 128 which separates an upper chamber 130 containing hydraulic oil from a lower chamber 132 containing engine lubricating oil. A branch conduit 134 runs from the conduit 114 to a normally-closed solenoid-operated valve 136 from which a conduit 138 leads to the upper chamber 130 of the cylinder 126. A conduit 140 branches from the conduit 138 to the hydraulic reservoir 124, the conduit 140 being interrupted by a normally-open valve 142. The hydraulic reservoir is provided with a vent 144. The chamber 132 for the cylinder 126 is connected by a conduit 146 to a spray nozzle 148 in the sump of the motor 100. The conduit 146 is interrupted by a normally-closed solenoid-actuated valve 150. The valves 142 and 150 are tied together for common operation, the valve 142 being open when the valve 150 is closed, and vice versa. The motor 100 is provided with an engine lubricating oil pump 152 which is connected by a conduit 154 through a check valve 156 to the lower chamber 132 of the piston 126. The check valve operates to permit flow only in the direction from the engine oil lubricating pump 152 to the chamber 126.

A battery 158 or other suitable source of electrical energy is connected through a switch 160 such as an ignition switch to actuate the solenoids of the valves 136 and 150 (plus 142) when the ignition switch is closed.

In operation, to start the engine the ignition switch 160 is closed, thereby connecting the cranking motor across the battery 158 so as to crank the diesel engine 100.

As soon as the ignition switch is closed, the valve 136 is moved to open position as is the valve 150, and the valve 142 is moved to closed position. When the engine was stationary, the pressure of the hydraulic fluid in the chamber 112 of the accumulator was extremely high, such as is conventional in a stand-by accumulator, e.g. from 250 to 10,000 psi, and preferably from 3,000 to 8,000 psi. Opening of the valve 136 connects the highly pressurized hydraulic fluid in the accumulator to the upper chamber 130. This high pressure is transmitted by the piston 128 to the engine lubricating oil in the lower chamber 132. Moreover, since the valve 150 now is open, the engine lubricating oil under the very high pressure mentioned flows from the lower chamber 132 to the atomizing nozzle 148 which, as in the case of the system described in connection with FIG. 1, is transformed into a very fine mist of oil particles moving at a high velocity away from the nozzle and onto all of the relatively movable surfaces in the engine 100. When the upper chamber 130 of the cylinder 126 is pressurized, the valve 142 is closed to prevent escape of the pressure through the conduit 140 to the hydraulic reservoir. The solenoid for the valves 142, 150 is provided with a time delay 162 which is long enough to permit the piston 128 to bottom in the cylinder 126 so that a premeasured quantity, i.e. slug, of oil is fed to the nozzle 148 for atomization, the quantity of oil being sufficient to fully prelubricate all of the relatively movable engine parts. The time delay is long enough to permit the engine to attain an operating speed. When the time delay cuts off, the valves 136, 142, 150 return to their idle position with the valve 136 closed, the valve 142 open, and the valve 150 closed. Closing of the valve 136 reduces the pressure on the hydraulic fluid in the upper chamber 130. Closing of the valve 150 prevents further flow of lubicating oil into the atomizing nozzle 148 from the lower chamber 132 of the cylinder 126. Opening the valve 142 permits flow of hydraulic fluid from the upper chamber 130 to the hydraulic reservoir 124, this flow taking place under the pressure generated by the engine lubricating oil pump which now is operating. Such flow takes place through the conduit 154 and the check valve 156.

Optionally, the lubricating oil can be pressurized directly against a gas cushion by a pump, thus eliminating the accumulator and hydraulic oil.

It thus will be seen that there are provided systems which achieve the various objects of the invention and which are well adapted to meet the conditions of practical use.

As various possible embodiments might be made of the above invention, and as various changes might be made in the embodiments above set forth, it is to be understood that all matter herein described or shown in the accompanying drawings is to be interpreted as illustrative and not in a limiting sense.

Having thus described the invention there is claimed as new and desired to be secured by Letters Patent:

1. In combination with a quick-starting fuel-burning engine having a running lubricating system and a sump and which has associated therewith a fluid energized rapid cranking system that includes:

(A) a fluid energizeable cranking motor,
(B) a stand-by source of fluid under pressure of from 250 to 10,000 psi,
(C) a first conduit connecting the source of fluid under pressure to the cranking motor,
(D) a normally closed valve in said conduit upstream of the cranking motor, and
(E) means for opening the valve when the motor is to be started, a prelubricating system that comprises:
(I) a chamber storing lubricating liquid,
(II) a second conduit connecting the source of fluid under pressure to said chamber,
(III) a valve in said second conduit which is normally closed,
(IV) means for opening the valve in said second conduit when the valve in the first conduit is opened to crank the engine whereby to pressurize the lubricating liquid,
(V) a spray nozzle in the engine sump, and
(VI) a third conduit connecting the lubricating liquid in said chamber with the spray nozzle,
(VII) the pressure imposed on the lubricating liquid by the stand-by source of fluid under pressure being high enough when the engine is started to force lubricating liquid under pressure through the third conduit and out of the spray nozzle as a fine rapidly moving mist to essentially instantaneously reach all relatively movable engine parts and lubricate the same as the engine is cranked.

2. A prelubricating system as set forth in claim 1 wherein means is iincluded to maintain the source of fluid is under a pressure of from 3,000 to 10,000 psi.

3. A prelubricating system as set forth in claim 1 wherein means is included to maintain the source of fluid is under a pressure of from 3,000 to 8,000 psi.

4. A prelubricating system as set forth in claim 1 wherein means is included to maintain said source of fluid under such pressure.

5. A prelubricating system as set forth in claim 1 wherein the chamber is a cylinder having a piston, lubricating liquid being disposed on one side of the piston, and said fluid being disposed on the other side of the piston.

6. A prelubricating system as set forth in claim 5 wherein the fluid is hydraulic oil.

7. The combination as set forth in claim 1 wherein the engine has a turbocharger, wherein in the prelubricating system a pressure regulator is interposed in the second conduit, and wherein a fourth conduit connects the chamber with the bearings of the turbocharger.

8. A prelubricating system as set forth in claim 7 wherein means is included to maintain flow of oil to the turbocharger bearings until the engine has been running long enough for the oil pressure developed in an engine oil lubricating pump operated by the engine to reach the bearings of the turbocharger.

9. In combination with a quick-starting fuel-burning engine having a running lubricating system and a sump and which has associated therewith a rapid cranking system and a stand-by source of fluid under pressure of from 250 to 10,000 psi, a prelubricating system that comprises:

(A) a first conduit extending from the source of fluid under pressure,
(B) a normally-closed valve in said conduit,
(C) means for opening the valve when the motor is to be started,
(D) a chamber storing lubricating liquid,
(E) said conduit downstream of said normally-closed valve connecting the stand-by source of fluid under pressure to said chamber,
(F) a spray nozzle in the engine sump,
(G) a second conduit connecting the lubricating liquid in said chamber with the spray nozzle,
(i) the pressure imposed on the lubricating liquid by the stand-by source of fluid under pressure being high enough when the engine is started to force lubricating liquid under pressure through the second conduit and out of the spray nozzle as a fine rapidly moving mist to essentially instantaneously reach all the relatively movable engine parts and lubricate the same as the engine is cranked.

10. In combination with an engine having a turbocharger:

(A) a stand-by source of fluid under pressure of from 250 to 10,000 psi,
(B) a chamber storing lubricating liquid,
(C) a conduit connecting the source of fluid under pressure to said chamber,
(D) a normally-closed valve in said conduit,
(E) means to crank the engine and concurrently to open said valve,
(F) a second conduit connecting the lubricating liquid in said chamber with the turbocharger bearings,
(G) a pressure-reducing valve in said first conduit, and
(H) means to maintain said normally closed valve open until oil from an engine lubricating oil pump has reached the turbocharger bearings after the engine is started.

11. A combination as set forth in claim 10 wherein means is included to maintain the pressure in the standby source of fluid from 250 to 10,000 psi.

* * * * *